United States Patent [19]

DuRocher et al.

[11] 4,038,743

[45] Aug. 2, 1977

[54] TERMINATING AND SPLICING ELECTRICAL CONDUCTORS

[75] Inventors: Gideon A. DuRocher; Ellsworth S. Miller, both of Mount Clemens, Mich.

[73] Assignee: Essex International, Inc., Fort Wayne, Ind.

[21] Appl. No.: 299,752

[22] Filed: Oct. 24, 1972

Related U.S. Application Data

[63] Continuation-in-part of Ser. No. 254,530, May 18, 1972, Pat. No. 3,826,000.

[51] Int. Cl.[2] ..... H01R 43/00

[52] U.S. Cl. ..... 29/628; 219/95; 228/904

[58] Field of Search ..... 29/475, 482, 552.2, 29/628, 629, 630 R; 339/275 R, 275 T; 228/3.5, 4.1, 25, 45, 50, 904; 219/95, 97, 100

[56] References Cited

U.S. PATENT DOCUMENTS

| | | | |
|---|---|---|---|
| 1,978,891 | 10/1934 | Blumberg et al. | 219/100 |
| 1,984,988 | 12/1934 | Raupach et al. | 219/97 |
| 2,100,880 | 11/1937 | Stansel | 219/100 |
| 2,187,452 | 1/1940 | Gordon et al. | 219/97 |
| 2,469,707 | 5/1949 | Albrecht | 219/100 |
| 2,836,703 | 5/1958 | Boyle et al. | 219/95 |
| 2,937,262 | 5/1960 | Baxter | 219/100 |
| 2,989,578 | 6/1961 | Wagner et al. | 156/433 |
| 3,119,927 | 1/1964 | Neukom et al. | 219/97 |
| 3,254,194 | 5/1966 | Phillips | 219/95 |
| 3,307,246 | 3/1967 | Gulliksen et al. | 29/630 |
| 3,397,451 | 8/1968 | Avedissian et al. | 29/589 |
| 3,479,482 | 11/1969 | Erwin et al. | 219/100 |
| 3,500,533 | 3/1970 | Sparling | 228/164 |
| 3,542,994 | 11/1970 | Deffenbaugh et al. | 219/100 |
| 3,553,827 | 1/1971 | Baker et al. | 29/573 |
| 3,561,084 | 2/1971 | Sims | 228/193 |
| 3,566,465 | 3/1971 | Weiner | 29/628 |
| 3,672,047 | 6/1972 | Sakamoto et al. | 29/628 |
| 3,684,474 | 8/1972 | Chisholm | 29/482 |
| 3,718,968 | 3/1973 | Sims et al. | 228/200 |

FOREIGN PATENT DOCUMENTS

| | | | |
|---|---|---|---|
| 952,488 | 11/1956 | Germany | 29/552.2 |

OTHER PUBLICATIONS

IBM Technical Disclosure Bulletin, vol. 13, No. 6, Nov. 1970, p. 1624.

*Primary Examiner*—James R. Duzan
*Attorney, Agent, or Firm*—Learman & McCulloch

[57] ABSTRACT

An individual metallic, electrical conductor is terminated by heating one end thereof to form an enlarged molten mass, followed by cooling and subsequent shaping of the mass to form a terminal. Multiple conductors are spliced by heating adjacent ends thereof to form an enlarged, common molten mass at the end of each conductor. Alternatively, adjacent ends of multiple metallic conductors may be spliced by heating the ends thereof to form a molten mass at the end of each conductor followed by plunging the molten masses into one another.

13 Claims, 32 Drawing Figures

TERMINATING AND SPLICING ELECTRICAL CONDUCTORS

RELATED APPLICATION

This application is a continuation-in-part of application Ser. No. 254,530, filed May 18, 1972, now U.S. Pat. No. 3,826,000. The invention disclosed herein relates to the terminating of metallic, electrical conductors and more particularly to the formation of an integral, homogeneous termination at either or both ends of a conductor. The invention also relates to the splicing of multiple conductors composed of either the same or different metals.

Conventional terminating of a conductor is accomplished by stripping insulation from at least one end of the conductor and joining that end to a terminal or to another conductor. A terminal of conventional construction may be formed from the same or different metal as that forming the conductor and the manner in which the conductor is joined to the terminal may involve any one of a number of processes, such as soldering, riveting, crimping, fusing, or the like. Regardless of the manner in which a separate terminal is joined to a conductor, there inevitably will be a voltage drop across the juncture of the conductor and the terminal. The voltage drop may be so small as to be expressed in millivolt units, but it nevertheless results in electrical losses and generates heat.

The conventional practice of joining a separate terminal to a conductor also has other disadvantages. For example, it not only is necessary to provide machinery for forming the terminal itself, but it also is necessary to provide apparatus for joining the terminal to the conductor. In many instances, the terminal must be joined not only to the conductor, but it also must be crimped or otherwise secured to the insulation surrounding the conductor. The terminal forming machinery and the terminal joining apparatus frequently represent a substantial investment in machinery and material handling systems, as well as in factory floor space necessary to accommodate such apparatus.

In many instances the joining of a separate terminal to a conductor effects weakening of the conductor at the juncture thereof with the terminal, thereby resulting in an assembly which has less strength than that of the conductor itself or that of the terminal itself. For example, standard 16-gauge copper wire may be required for some purposes to be capable of withstanding a tensile force of 50 lbs., and the conventional brass or other terminal must be capable of withstanding a tensile force at least as great. When the terminal is crimped or otherwise joined to the wire, however, the assembly in many cases is incapable of withstanding a tensile force of 50 lbs.

In those instances in which a conventional, separate terminal is crimped or otherwise joined to one end of a stranded wire conductor, it is impossible to assure that each strand of the conductor conducts its share of a current load. As a consequence, apparently uniform stranded conductor and terminal assemblies may have greatly differing electrical properties.

Even though the utmost care may be taken in forming terminals and in joining them to conductors, it virtually is impossible to prevent at least some of the terminals from being malformed or improperly joined to their conductors, if for no reason other than that the forming and joining machinery cannot always function perfectly because of wear, for example. If a terminal is joined improperly to its conductor, or is malformed, it may not be capable of being joined to a mating or companion conductor with proper electrical integrity. If it can be joined to a mating or companion conductor, a malformed or misjoined terminal may increase the voltage drop between the terminal and its conductor. In addition, a terminal which is imperfectly formed or joined to its conductor is difficult to assemble in a connector.

The conventional terminating of insulated magnet wire of the kind used in relays, alternators, motors, and the like is particularly troublesome inasmuch as the insulation must be either pierced or removed from the wire to enable a terminal to be affixed thereto or to enable the wire to be spliced to another wire. Such wire often is of quite small diameter with the result that the piercing or removal of the insulation causes substantial weakening of the wire at its juncture with the terminal or the other wire.

There are many instances in which conductors composed of different metals must be spliced. Because of metallurgical differences between different metals the electrical and mechanical characteristics of the splice often are objectionable. For example, thermal splices between copper and aluminum conductors heretofore have been notoriously weak mechanically due to brittleness of the joint, thereby making it impossible for spliced copper and aluminum conductors to withstand tensile forces that either of the conductors individually could withstand with ease.

Among the objects of this invention is that of terminating either or both ends of an electrical conductor so as to avoid the problems inherent in the joining of conductors to one another or to separate terminals and at the same time obtaining advantages superior to those of conventional terminations.

Another object of the invention is to provide simple, inexpensive methods for forming integral terminations at the ends of either stranded or solid conductors.

A further object is to provide a method of forming terminations at the ends of conductors and which avoid structural weakening of the conductor while at the same time providing improved electrical and physical properties.

Another object of the invention is to provide methods for improving the joining or splicing of conductors of either the same or different metals, including conductors having insulation thereon, and without necessitating removal of the insulation prior to the joining of the conductors.

Other objects and advantages of the invention will be pointed out specifically or will become apparent from the following description when it is considered in conjunction with the appended claims and the accompanying drawings, in which:

FIG. 1 is a fragmentary, elevational view illustrating the formation of an enlarged, homogeneous termination at one end of an electrical conductor;

FIGS. 2 and 3 are cross-sectional views taken on the lines 2—2 and 3—3, respectively, of FIG. 1;

Figure 1:
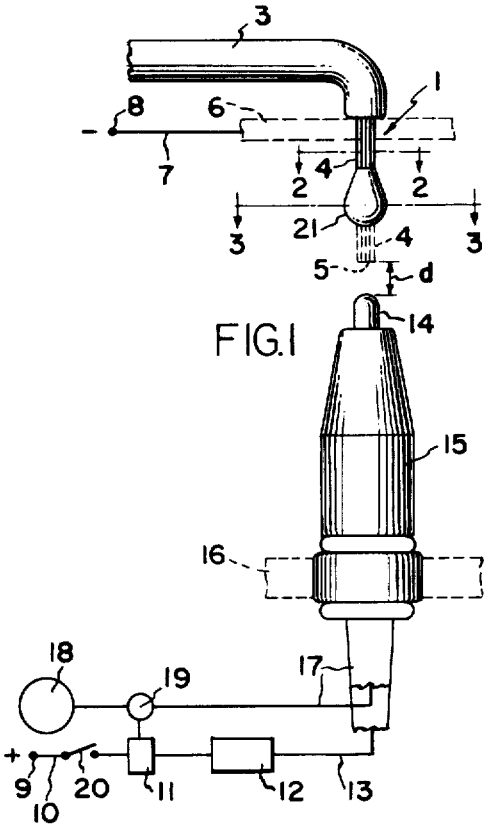
Figure 9:
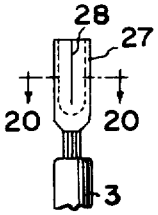
Figure 12:
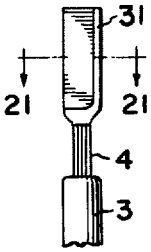
Figure 20:
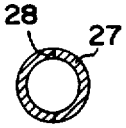
Figure 21:
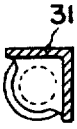
Figure 22:
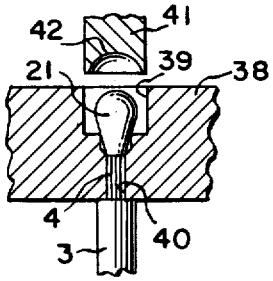
Figure 23:
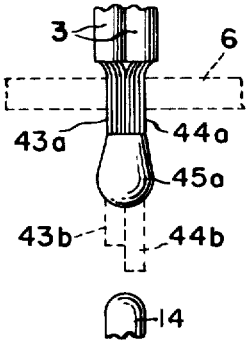
Figure 24:
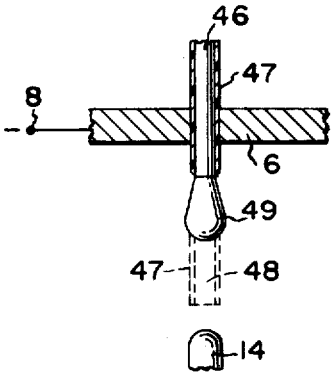
Figure 25:
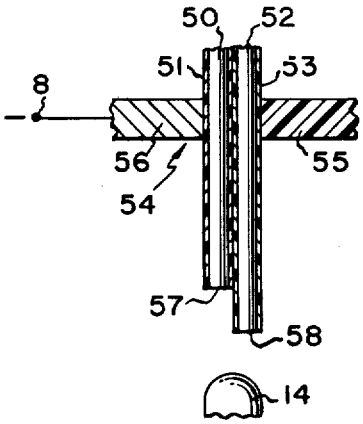
Figure 26:
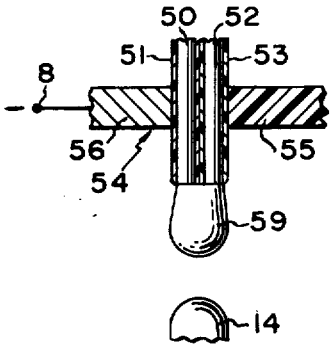
Figure 27:
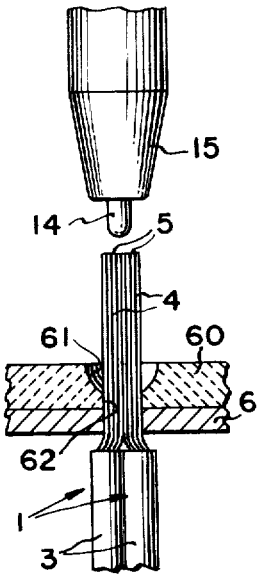
Figure 29:
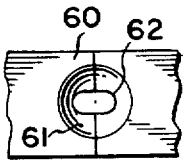
Figure 28:
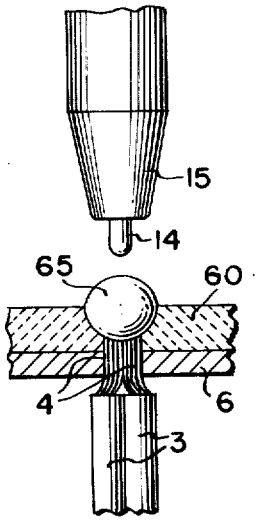
Figure 30:
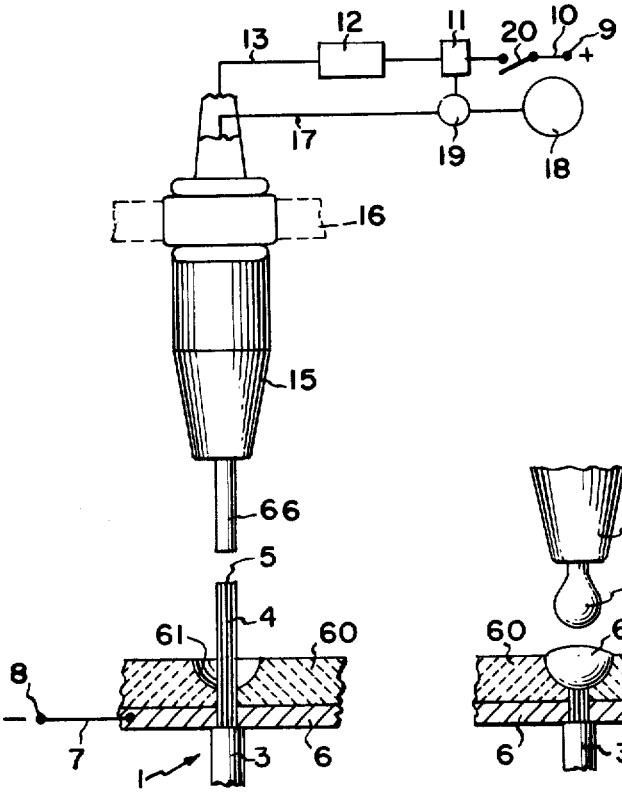
Figure 31:
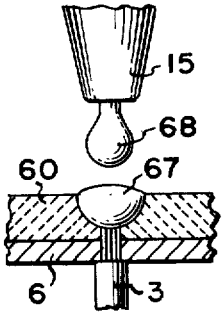
Figure 32:
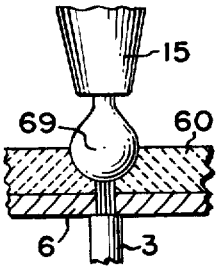

FIGS. 20 and 21 are transverse sectional views taken on the lines 20—20 and 21—21, respectively, of FIGS. 9 and 12;

FIG. 22 is a horizontal sectional view through a typical shaping die assembly by means of which a terminal may be formed;

FIG. 23 is a fragmentary view similar to FIG. 1 but illustrating a modified method of splicing a pair of conductors;

FIG. 24 is a greatly enlarged, fragmentary view similar to FIG. 1, but partly in section, and illustrating terminating of an insulated wire;

FIG. 25 is a view similar to FIG. 24 and illustrating a pair of insulated wires supported for splicing;

FIG. 26 is a view similar to FIG. 25, but illustrating the spliced wires;

FIG. 27 is a fragmentary view similar to FIG. 1, but illustrating the initial stage of a modified method of splicing and terminating a pair of conductors;

FIG. 28 is a view similar to FIG. 27, but illustrating the concluding stage of the modified method;

FIG. 29 is a fragmentary, top plan view of a part of the apparatus shown in FIGS. 27 and 28;

FIG. 30 is a view similar to FIG. 1, but illustrating the initial stage of a further embodiment of splicing a pair of conductors;

FIG. 31 is a fragmentary view similar to FIG. 30, but illustrating an intermediate stage of the modified method; and FIG. 32 is a view similar to FIG. 31, but illustrating the concluding stage of the modified method.

Terminations according to the embodiment of the invention shown in FIG. 1 may be formed at either or both ends of a copper or other electrically conductive, metallic conductor 1 composed of either a single, solid wire or a plurality of wire strands. For purposes of illustration, the conductor 1 shown herein is composed of a plurality of parallel strands 2 of copper wire. The conductor 1 may be either bare or insulated. As disclosed, the conductor is positioned within a conventional, polyvinylchloride or the like insulation sheath 3 which has been stripped, in a conventional manner, from one end portion 4 of the conductor, the portion 4 terminating in a free end 5.

The formation of a termination according to the embodiment of the invention disclosed in FIG. 1 comprises heating the exposed conductor portion 4 from the free end 5 thereof to such a temperature and for a sufficient period of time to cause the metal of the conductor to become molten. The temperature to which the conductor must be subjected is at least the melting temperature of the particular metal of which the conductor is composed and such temperature will vary in accordance with the composition of the metal. The melting temperatures of different metals are readily obtainable from metallurgical handbooks or may be determined empirically. The time during which the conductor is exposed to the metal-melting temperature will vary, as will be pointed out hereinafter.

The disclosed method of terminating the conductor 1 comprises supporting the bared end portion 4 in a vertical plane with the free end 5 lowermost. That portion of the bared conductor adjacent the end of the insulation 3 may be gripped in an electrically conductive clamp 6 which is connected by a conductor 7 to the negative terminal 8 of a battery (not shown) or other source of electrical potential. The clamp 6 provides electrical conductivity between the conductor 4 and the power source and also locates the free end 5 of the conductor at a predetermined level. To the positive terminal 9 of the battery or the like is connected a conductor 10 which is connected through a known, adjustable timer 11 to a conventional arc welding machine 12. From the machine 12 extends a conductor 13 which is joined to a preferably tungsten electrode 14 that is supported in a housing 15. The housing is mounted by means of a bracket 16 or the like in such position that the tip of the electrode 14 initially is positioned directly beneath the bared portion of the conductor 1 and at a predetermined distance *d* from its free end 5 sufficient to sustain an arc between the tip of the electrode and the free end of the conductor. The housing 15 preferably includes passages (not shown) connected by a conduit 17 to a pressurized source 18 of inert gas such as argon. The timer 11 controls the operation of the machine 12 and also controls a valve 19 mounted in the conduit 17 between the housing 15 and the source 18.

In the operation of the apparatus shown in FIG. 1, closing of a normally open switch 20 in the conductor 10 applies to the electrode 14 a voltage sufficient to establish an arc between the electrode and the free end 5 of the conductor. The arc welding machine 12 preferably is of the kind having a variable voltage control so as to assure the application of a sufficiently high voltage to the electrode that the arc established between the electrode and the conductor 1 has a temperature sufficient to melt the metal of which the conductor 1 is formed. As a consequence, the establishment of an arc causes the free end 5 of the conductor 1 to become molten. The valve 19 normally is closed, but closing of the switch 20 energizes the timer 11 which, in turn, opens the valve 19 thereby permitting inert gas from the source 18 to be discharged from the housing 15 and envelop the bared portion 4 of the conductor 1. Consequently, oxidation of the metal in its molten state is prevented.

As the metal of which the conductor 1 is formed is melted, the interface between the molten metal and the surrounding inert atmosphere results in the metal's possessing surface tension. As a result of the surface tension, continued melting of the metal causes the molten metal to climb the vertical conductor portion 4 and the force of the surface tension shapes the molten metal into an enlarged, symmetrical pear-shaped mass tapering toward the opposite or upper end of the conductor portion 4. As the metal continues to be melted, the climbing movement of the molten mass increases the space between the electrode 14 and the lower surface of the mass. When the distance between the electrode and the lower surface of the mass increases to an amount such that the arc no longer can be sustained, the arc will be extinguished and no further melting of the conductor 1 occurs. The molten mass thus will cool and solidify so as to form a solid, metallurgically homogeneous, pear-shaped termination nodule 21 at the free end of the conductor 1.

Although extinguishing of the arc may be effected in the manner above described, it is preferred that the distance *d* between the electrode 14 and the free end of the conductor be maintained substantially uniform. This result may be achieved simply by mounting the clamp 16 for vertical movements so as to permit the electrode to follow movement of the molten mass. Alternatively, the clamp 6 could be mounted for vertical movements toward and away from the electrode 14.

The maximum size of the molten mass formed by melting of the free end of the conductor 1 is limited to one in which the gravitational force acting on the mass does not exceed the force of the surface tension. Thus, the size of the molten mass cannot be greater than one in which the force of the surface tension slightly exceeds the gravitational force acting on the molten metal. The mass may, however, have any size smaller than the maximum. The size of the molten mass may be determined quite accurately by means of the timer 11 which will act to interrupt the circuit to the electrode 14, and close the valve 19, following the elapse of a predetermined period of time not exceeding that required to form a molten mass having the maximum size or weight.

Figure 2:
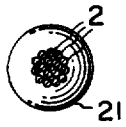
Figure 3:
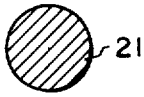

If the conductor 1 is formed of multiple strands 2 of wire, those portions of the strands that are not subjected to the heat of the arc are unaffected. See FIG. 2. Those strands which are subjected to the heat of the arc, however, lose their identity and become part of the homogeneous nodule 21. See FIG. 3. The metallurgical and electrical properties of the nodule 21, however, are the same as those of the individual strands. Those portions of the strands which are not subjected to the heat of the arc emanate from the nodule 21 so that each strand is capable of carrying its full share of an electrical current.

Although the foregoing description has been concerned with a stranded conductor 1, it will be understood that the disclosed process is equally applicable to a solid wire conductor.

If the conductor 1 is composed of aluminum, or some other metal having a lower thermal conductivity than that of copper, it has been found that greater strength at the juncture of the nodule and the conductor may be obtained by the use of an intermittent arc. In this instance, the timer 11 may constitute a stepping or intermittently operable device capable of interrupting the arc at periodic intervals. An intermittent arc causes alternate heating and cooling of the free end of the conductor and results in a much stronger juncture between the nodule and an aluminum conductor than is obtained if the arc is continuous. Nevertheless, the shape of the nodule is the same as has been described.

When utilizing an intermittent arc process the voltage applied to the arcing electrode, the duration of the arc, the time between successive arcs, and the number of arc pulses per unit of time can be varied according to the composition of the conductor and the results sought to be obtained. Thus, if the juncture between a nodule and a conductor must be capable of withstanding a tensile force of ten pounds, the procedures followed in the formation of the nodule will be different from those followed in the formation of one which must withstand a tensile force of 20 pounds. These procedures may be determined empirically.

Following cooling and solidification of the molten mass to form the nodule 21 it may be shaped by conventional means into any one of a large number of different kinds of terminals, some of which are shown in FIGS. 4 – 18. Each of these figures discloses a conventional terminal of the kind which heretofore has been crimped or otherwise secured to the free end of a conductor or to the free end of the conductor and to the adjacent end of the insulation sheath. Terminals constructed according to the invention, however, are formed integrally at the free end of the conductor portion 4 and need not be secured to the insulation sheath 3.

Figure 4:
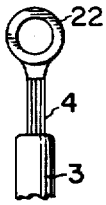
FIGS. 4 - 18 are fragmentary, side elevational views illustrating typical terminals which may be formed at the ends of conductors.
Figure 5:
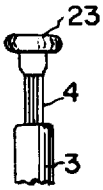
Figure 6:
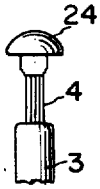
Figure 7:
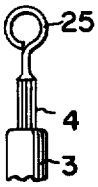
Figure 8:
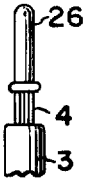
Figure 10:
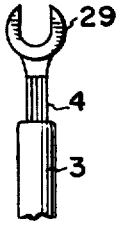
Figure 11:
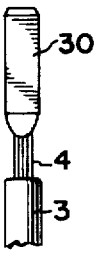
Figure 13:
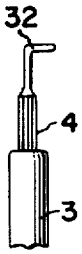
Figure 14:
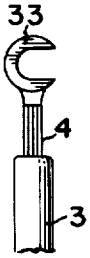
Figure 15:
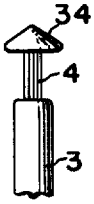
Figure 16:
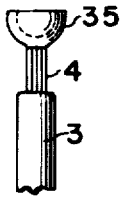
Figure 17:
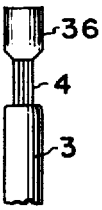
Figure 18:
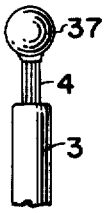

The terminal shown in FIG. 4 comprises an eyelet terminal 22, the terminal shown in FIG. 5 comprises a button terminal 23, the terminal of FIG. 6 comprises a mushroom terminal 24, the terminal of FIG. 7 comprises an open-ended socket or sleeve terminal 25, the terminal of FIG. 8 comprises a pin terminal 26, the terminal of FIG. 9 comprises a socket terminal 27 having one closed end and one or more axially extending slits 28, the terminal of FIG. 10 comprises a spade terminal 29, the terminal of FIG. 11 comprises a blade terminal 30, the terminal of FIG. 12 comprises a corner terminal 31, the terminal of FIG. 13 comprises a tap terminal 32, the terminal of FIG. 14 comprises a 90° offset spade terminal 33, the terminal of FIG. 15 comprises a conical terminal 34, the terminal of FIG. 16 comprises a cup terminal 35, the terminal of FIG. 17 comprises a cylindrical terminal 36, and the terminal of FIG. 18 comprises a spherical terminal 37.

Terminals of the kind disclosed in the drawings, as well as other terminals of conventional configuration, may be formed by conventional shaping or forming apparatus of the kind typified in FIG. 22. This apparatus comprises a base 38 having a cavity 39 therein for reception of the nodule 21 and which communicates with an opening 40 in which the conductor portion 4 may be received and clamped. A vertically movable die 41 having a convex lower surface 42 is adapted to move into and out of the cavity 39 and deform the nodule 21 so as to produce the mushroom terminal 24 shown in FIG. 6. It will be understood that dies of conventional design will be utilized in the formation of the other kinds of terminals.

A distinct advantage of terminations formed in accordance with the invention as thus far described is that the nodule 21 is symmetrical and tapers in a direction toward the opposite end of the conductor. As a result, a terminal formed by shaping or deforming of the nodule merges smoothly along curved lines into the bared portion 4 of the conductor, thereby enabling the juncture between the portion 4 and the terminal to be capable of withstanding considerably more tensile force than it could if the juncture were angular. For example, conventional pull-off tests conducted on terminals constructed according to the invention have shown that the juncture between the terminal and the conductor is at least as strong in tension as the conductor itself.

Figure 19:
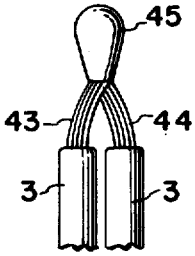
FIG. 19 is a fragmentary, elevational view illustrating the terminating or splicing of two conductors according to the invention.

The principles of the invention as thus far described are not limited to the formation of terminals. The invention also is applicable to the terminating of two or more conductors in splice joints. FIG. 19 discloses a pair of stranded conductors 43 and 44 the free ends of which have been joined in an enlarged, pear-shaped termination nodule 45 formed in the same manner as the nodule 21 previously described. In forming the nodule 45 the free ends of the conductors 43 and 44 are supported at the same level so as to be subjected simultaneously to either a continuous or intermittent arc. The only difference between the formation of the nodule 45 and the nodule 21 is that the free ends of both of the conductors 43 and 44 are subjected to the arc so that the metals of both conductors are melted to form a metallurgically homogeneous enlargement.

One of the advantageous characteristics of the invention is that it enables multiple conductors of either the same or different materials to be terminated or spliced. For example, both of the conductors 43 and 44 may be formed of copper strands or solid copper wires, or one may be stranded copper and the other solid copper. In either event the nodule 45 will be a solid, homogeneous mass of copper. Alternatively, if the conductor 43 is formed of copper and the other conductor 44 is formed of aluminum for example, the nodule 45 will constitute a copper-aluminum alloy that is metallurgically homogenous. Such an alloy is quite hard and brittle and, therefore, cannot readily be shaped to form a terminal in the same manner as has been disclosed heretofore, but if the conductors 43 and 44 are formed of such metals that the nodule 45 is ductile, as is the case of copper, the nodule 45 can be shaped to form a terminal, if desired.

In the joining of conductors, formed of dissimilar metals, the composition of the nodule may be varied by locating the free ends of the conductor at different levels. This process is illustrated in FIG. 23 wherein a conductor 43*a* has its free end 43*b* supported at a level above the level of the free end 44*b* of a conductor 44*a*, both of the conductors being located in the path of an arc from the electrode 14, but the distance from the electrode to the end 43*b* initially being too great to sustain an arc therebetween. In this case the arc first will effect melting of the conductor 44*a*, followed by melting of the conductor 43*a* as the electrode is moved to follow the molten mass. The nodule 45*a* thus formed will constitute a solid, homogeneous alloy of the materials from which the conductors are formed, but the predominant material in the nodule will be that from which the conductor 44*a* is formed. This process may be utilized to reduce the brittleness of a copper-aluminum alloy.

Although the free end of a conductor may be terminated by a process in which the free end of the conductor is supported vertically and above the arc-producing electrode so as to produce a symmetrical, pear-shaped nodule, there are other methods by which terminals may be formed. For example, the conductor 1 may be laid on a flat, horizontal body of refractory material and be connected to the negative terminal of the battery, and the electrode 14 moved either mechanically or manually to a position adjacent the free end 5 so as to establish a heat generating arc between the electrode and the free end of the conductor. The heat generated by the arc will melt the metal at the free end of the conductor, and the interface of the molten metal with the surrounding atmosphere will establish surface tension at the surface of the molten metal causing it to remain a cohesive, homogeneous mass as the melting of the conductor continues toward its opposite end, thereby resulting in an enlarged molten mass at the end of the exposed portion of the conductor. When the conductor lies horizontally on a refractory material, the molten mass will not be pear-shaped, but the size of the molten mass be as large as desired or, stated differently, the time during which the conductor is exposed to heat is that required to produce a mass of desired size. The mass will be symmetrical about a central, vertical plane.

When a sufficient quantity of metal has been melted to form a mass of desired size the arc may be extinguished, whereupon the molten mass cools immediately and solidifies to form a termination nodule. The nodule then may be formed into a terminal, if desired, as hereinbefore described.

The invention as thus far described is particularly adapted to the terminating of magnet wire coated with conventional enamel, varnish, or polymeric insulation, and without requiring prior removal of the insulation. FIG. 24 discloses a conventional, copper magnet wire 46 which carries a coating of insulation 47 and terminates in a free end 48. The insulated wire is supported vertically in the clamp 6 with its free end 48 lowermost and directly over the electrode 14. The free end of the wire is subjected to an arc, as earlier described, to cause the metal to become molten and form a pear-shaped mass which subsequently is permitted to solidify and form a termination nodule 49 which may be shaped into a terminal of desired form.

In the heating of the free end of the insulated wire 46, it is preferable that the heating take place in an oxygen-containing atmosphere such as air, rather than in an inert atmosphere, until just prior to the extinguishing of the arc. This assures sufficient oxygen to enable the insulation adjacent the free end of the wire to be consumed so that it does not contaminate the molten metal. Just prior to the extinguishing of the arc, however, the inert gas is caused to envelop the molten metal and to continue to envelop the mass until such time as it has solidified to form the nodule 49. Enveloping the molten mass in an inert atmosphere as the mass cools prevents oxidation of the molten metal during its cooling and solidification stage. The time between the envelopment of the molten metal by an inert gas and the termination of the arc may be of extremely short duration such as 0.25 - 0.5 second, for example.

In practicing the process illustrated in FIG. 24 the voltage applied to the electrode 14 must be sufficiently high to establish a current path between the wire 46 and the clamp 6 through the insulation 47.

The splicing of a plurality of magnet wires is illustrated in FIGS. 25 and 26 wherein a copper wire 50 coated with insulation 51 is placed adjacent a similar wire 52 coated with insulation 53 and clamped in a clamp 54 having a non-conductive part 55 and a conductive part 56 connected to the terminal 8 of the power source. The insulated wires 50 and 52 bear against each other with the wire 50 bearing against the conductive clamp part 56 and the wire 52 bearing against the non-conductive part 55. The wires 50 and 52 are supported by the clamp 54 with their free ends 57 and 58, respectively, lowermost and directly over the electrode 14. The free ends of the wires are not located at the same level, however, but are staggered or located at different levels. The wire 50 which engages the conductive clamp part 56 is supported in such manner that its free end 57 is at a higher level than that of the free end 58 of the wire 52. As a consequence, the free end of the wire 50 is located at a greater distance from the electrode 14 than is the free end of the wire 52.

In practicing the process illustrated in FIGS. 25 and 26 the voltage applied to the electrode 14 must be sufficiently high to establish a current path from the part 56 through the insulation 51 to the wire 50, but the distance between the electrode 14 and the free end 57 of the wire 50 must be greater than that at which an arc may be established between the electrode 14 and the free end 57. The voltage also must be sufficiently high to permit a current path to be established between the wires 50 and 52 through the respective coatings of insulation 51 and 53. The distance between the electrode 14 and the free end 58 of the wire 52 must be such as to permit an arc to be established therebetween so as to effect heating of the free end 58 to render the latter molten. The electrode may be moved relatively to the wires 50 and 52 as the latter is melted at its free end so as to reduce the distance between the electrode and the free end 57 of the wire 50. It is important that the free ends of both of the wires be positioned in the path of the arc so that, when the distance from the free end 57 and the electrode is such to sustain an arc therebetween, such an arc will be established so as to effect simultaneous melting of the free ends of both of the wires 50 and 52 to establish a homogeneous, pear-shaped molten mass which subsequently may be cooled and solidified to form a termination nodule 59. The nodule may be shaped, if desired, to form a terminal. Again, heating of the wires 50 and 52 preferably occurs in air until just before the arc is extinguished, thereby effecting consumption of the insulation adjacent the molten metal. Just before the arc is extinguished, however, the molten mass is enveloped in an inert atmosphere which is maintained until the mass solidifies and forms the nodule 59.

Heating of the wires 50 and 52 in an oxygen-containing atmosphere causes some oxidation of the molten metal, of course, but the amount of such oxidation, especially when oxidation is prevented during cooling of the metal, does not materially affect the strength or the electrical properties of the nodule.

The voltage to which the electrode must be subjected, the spacing between the electrode and the nearest conductor, and the difference in the levels of the conductors will depend primarily on the electrical and physical properties of the conductors and their insulation. For conductors and insulation of differing properties, the voltage and spacing requirements may be determined empirically.

Another method of forming a substantially symmetrical nodule greater in size and weight than that which may be supported by the force of surface tension is illustrated in FIGS. 27 - 29. In this method the clamp 6 supports a split block 60 formed of carbon or other refractory material and in the upper surface of which is formed a semi-hemispherical or other shaped well 61. At the bottom of the well is an opening 62 through which a pair of side-by-side conductors 4 pass so that their free ends 5 are uppermost and above the well. The particular shape of the opening 62 may vary in accordance with the size and number of the conductor or conductors to be terminated or spliced, and the block 60 is split to enable it to be separated so as to permit the conductor or conductors to be moved into and out of the well. The housing 15 is positioned above the conductors 4 so that the tip of the electrode 14 is located adjacent, but spaced from, the free ends of the conductors.

In the operation of the apparatus shown in FIGS. 27 - 29, the establishing of an arc between the electrode 14 and the free ends of the conductors 4 melts the metal of the conductors and enables the molten metal to flow downwardly from the free ends thereof, the electrode 14 being moved downwardly as the metal melts, whereupon the molten metal collects in the well 61. Inert gas issues from the housing 15 as hereinbefore described. Preferably, the length of the conductors 4 which initially projects above the well is such that the molten mass forms a puddle which projects above the well. Surface tension acting on the molten mass, coupled with the shape of the well, will cause the mass to assume a rounded, symmetrical configuration as is shown in FIG. 28. The mass then may be cooled so as to solidify and form a homogenous nodule 65 which may be shaped, if desired, into a terminal of desired configuration. It will be understood that the size and shape of the well 61 may be varied to produce a nodule having a desired form.

FIGS. 30, 31, and 32 disclose apparatus and a process which are particularly well adapted for the splicing of conductors composed of different metals, although conductors formed of similar metals may be spliced in the same manner and using the same apparatus.

The apparatus disclosed in FIG. 30 is the same as that shown in FIG. 29, but in the embodiment of FIG. 30 only a single, stranded copper conductor 4 is shown and the tungsten electrode 14 has been replaced by a length of solid aluminum wire 66 to which the conductor 13 is connected. In this instance, therefore, the wire 66 constitutes not only one of the conductors to be spliced or joined to the conductor 4, but also constitutes the electrode of the arc welding machine.

In the operation of the apparatus shown in FIG. 30, the housing 15, in which the conductor 66 is fitted, is supported at a level above the free end 5 of the conductor 4 so as to establish a gap between the confronting ends of the conductors 4 and 66. The switch 20 then may be closed so as to establish an arc between the conductors 5 and 66 having a temperature sufficient to effect melting of both of the conductors. Simultaneously, the valve 19 opens to permit inert gas from the source 18 to be discharged from the housing 15 to envelop the confronting ends of the conductors 5 and 66.

As the conductor 4 melts, the molten metal will flow downwardly into the well 61, as described earlier, to form a molten mass 67. As the conductor 66 melts, the molten metal will climb upwardly to form an enlarged, pear-shaped molten mass 68, in the same manner as hereinbefore described. As the two conductors melt, the housing support 16 is moved downwardly to prevent the spacing between the conductors 5 and 66 from increasing to a distance insufficient to sustain the arc as the ends of the conductors melt, thereby maintaining the arc and continuing the melting of the conductors and the formation of the respective molten masses 67 and 68.

When the molten masses 67 and 68 reach the desired size, the arc is extinguished and substantially simultaneously therewith the housing 15 is moved downwardly a distance to plunge the molten mass 68 into the molten mass 67 and unite the two masses into a single nodule 69 while both masses are molten. During the uniting of the two masses, and during the cooling of the combined masses, inert gas continues to issue from the housing 15 so as to prevent oxidation of the nodule 69.

The plunging of one molten mass into the other molten mass provides a splice or weld which has surprising tensile strength. Tests have demonstrated that the tensile strength of the aluminum-copper weld approaches the tensile strength of the weaker of the two conductors.

It is believed that the relatively high tensile strength of the joint is due to two factors. First, the plunging of one molten mass into the other molten mass results in a forging of the two masses causing the interface between the two masses to assume a highly irregular configuration. Following the solidification and fusion of the molten masses, the fusion layer between the two different materials also is irregular so that, when the splice is subjected to tension, much of the fusion layer is then subjected to shear force, rather than to purely tensile force. As a consequence, the mechanical bond between the two dissimilar metals is much greater than that which would result from a substantially straight line fusion layer. The second contributing factor to the increased tensile strength of the aluminum-copper splice is believed to be the result of joining the molten masses in an inert atmosphere, thereby preventing the dissolution of oxygen in the molten copper during the welding of the metals and preventing or minimizing the formation of voids or solidification defects due to gas porosity.

Although the process disclosed in FIGS. 30 - 32 has been disclosed as one in which the copper conductor is stranded and is positioned below the aluminum conductor, equally good results are obtained by utilizing either solid or stranded aluminum and copper conductors, and reversing the positions of the aluminum and copper conductors. Moreover, the arc between the two conductors can be continuous during the melting process, as described, or the arc can be an intermittent arc as was described earlier herein. Furthermore, insulated, copper magnet wires of the kind hereinbefore referred to may be joined to aluminum conductors according to to the process of FIGS. 30 - 32, with the exception that the copper conductor is melted in an oxygen-containing atmosphere for the purpose of consuming the insulation, but just prior to the plunging of the molten mass at the end of one conductor into the molten mass at the end of the other conductor, the masses are enveloped in an inert atmosphere which is sustained until the joined masses solidify.

This disclosure is intended to be illustrative rather than definitive of the invention. The invention is defined in the claims.

We claim:

1. A method of joining adjacent ends of a pair of metallic, electrical conductors comprising supporting said conductors with adjacent ends thereof in vertically spaced, confronting relation; heating the confronting ends of said conductors to a temperature at which the ends of said conductors become molten; collecting the molten metal of the lowermost conductor in a well of such size as to form an enlarged molten mass at the end of said lowermost conductor; continuing the heating of the end of at least the uppermost conductor for a period of time such that the combined forces of gravity and surface tension shape the molten metal into an enlarged, pear-shaped molten mass suspended from said uppermost conductor while maintaining the end of the lowermost conductor molten; relatively moving said conductors toward one another a distance sufficient to engage said molten mass of the uppermost conductor with the molten metal of said lowermost conductor to form a molten nodule; and solidifying the molten nodule.

2. The method according to claim 1 wherein the heating of the ends of said conductors is effected by establishing an electric arc between said ends.

3. The method according to claim 1 wherein said conductors are formed of different metals.

4. The method according to claim 3 wherein one of said conductors is copper and the other of said conductors is aluminum.

5. The method according to claim 2 wherein said arc is applied continuously.

6. The method according to claim 2 wherein said arc is applied intermittently.

7. The method according to claim 1 including enveloping the confronting ends of said conductors in an inert atmosphere during the heating thereof.

8. The method according to claim 1 including enveloping the ends of said conductors in an inert atmosphere as said ends are moved into engagement.

9. The method according to claim 1 including enveloping said nodule in an inert atmosphere during the solidification thereof.

10. The method according to claim 1 wherein at least one of said conductors is composed of stranded metal.

11. The method according to claim 1 wherein at least one of said conductors is composed of solid metal.

12. The method according to claim 1 wherein the heating of the confronting ends of said conductors is conducted at least initially in an oxygen-containing atmosphere.

13. The method according to claim 2 including relatively moving said conductors toward one another during the heating of the ends thereof to maintain said ends at a distance sufficient to maintain said arc.

* * * * *